US012516482B2

(12) United States Patent
Barnes et al.

(10) Patent No.: US 12,516,482 B2
(45) Date of Patent: Jan. 6, 2026

(54) PILE GUIDE WITH REPLACEABLE INSERTS

(71) Applicants: Sean Barnes, Mt. Pleasant, SC (US); Michael Kirby, Mt. Pleasant, SC (US)

(72) Inventors: Sean Barnes, Mt. Pleasant, SC (US); Michael Kirby, Mt. Pleasant, SC (US)

( * ) Notice: Subject to any disclaimer, the term of this patent is extended or adjusted under 35 U.S.C. 154(b) by 108 days.

(21) Appl. No.: 18/527,569

(22) Filed: Dec. 4, 2023

(65) Prior Publication Data

US 2025/0180159 A1 Jun. 5, 2025

(51) Int. Cl.
*E02B 3/06* (2006.01)

(52) U.S. Cl.
CPC ..... *E02B 3/064* (2013.01)

(58) Field of Classification Search
CPC ..... E02B 3/064
See application file for complete search history.

(56) References Cited

U.S. PATENT DOCUMENTS

| | | | | |
|---|---|---|---|---|
| 3,074,239 | A | 1/1963 | Mustard | |
| 3,270,698 | A | 9/1966 | Fort | |
| 3,559,947 | A | 2/1971 | Sette | |
| RE27,090 | E | 3/1971 | Rutter | |
| 3,603,276 | A | 9/1971 | De Lisle | |
| 3,727,415 | A | 4/1973 | Williams | |
| 3,967,570 | A | 7/1976 | Bradfield | |
| 4,018,179 | A | 4/1977 | Rutter | |
| 4,072,119 | A | 2/1978 | Williams | |
| 4,276,849 | A | 7/1981 | Bloxham | |
| 4,280,429 | A | 7/1981 | Wells | |
| 4,510,877 | A | 4/1985 | Bloxham | |
| 4,641,595 | A | 2/1987 | Pritchett | |
| 4,642,000 | A * | 2/1987 | Lin | E02B 3/064 114/263 |
| 4,763,592 | A | 8/1988 | Russ | |
| 4,782,778 | A | 11/1988 | Barbaglia | |
| 5,002,000 | A | 3/1991 | Rutter | |

(Continued)

FOREIGN PATENT DOCUMENTS

| | | | |
|---|---|---|---|
| CN | 216141974 U | * | 3/2022 |
| DE | 2042850 | | 3/1972 |

(Continued)

OTHER PUBLICATIONS

U.S. Appl. No. 65/226,902, filed Mar. 4, 2003, Faber.

(Continued)

*Primary Examiner* — Janine M Kreck
(74) *Attorney, Agent, or Firm* — B. Craig Killough

(57) ABSTRACT

A pile guide has a body formed of thermoplastic polymer, such as polyethylene. The body has an internal area constructed and arranged to receive and retain a pile in the internal area of the body. A plurality of inserts formed of thermoplastic polymer, such as polyethylene, are attached to the internal area of the body and extend outwardly from the internal area of the body so that contact of the pile is with the inserts. The inserts are replaceable so that as the inserts wear due to frictional engagement with the pile, worn inserts may be replaced without replacement of the other components of the pile guide. The inserts are preferred to be formed of a corrosion resistant, low friction, chemical resistant, high impact and low moisture absorbing thermoplastic material.

25 Claims, 6 Drawing Sheets

(56) References Cited

U.S. PATENT DOCUMENTS

| | | | |
|---|---|---|---|
| 5,016,551 | A | 5/1991 | Peck et al. |
| 5,046,897 | A | 9/1991 | Ray |
| 5,140,922 | A | 8/1992 | Bowman et al. |
| 5,394,814 | A | 3/1995 | Rutter et al. |
| 5,549,070 | A | 8/1996 | Cruchelow et al. |
| 5,664,513 | A | 9/1997 | Echelbarger |
| 5,826,528 | A | 10/1998 | Jancsek |
| 5,860,379 | A | 1/1999 | Moody |
| 5,860,765 | A | 1/1999 | Cruchelow et al. |
| 6,145,463 | A | 11/2000 | Zeilinger |
| 6,179,525 | B1 | 1/2001 | Gruhn et al. |
| 6,477,968 | B2 | 11/2002 | Powell |
| 6,547,485 | B2 | 4/2003 | Elson |
| D506,668 | S | 6/2005 | Black |
| 7,153,064 | B2 | 12/2006 | Zeilinger et al. |
| 7,390,141 | B2 | 6/2008 | Rytand |
| 7,406,924 | B1 | 8/2008 | Impey |
| 8,267,621 | B1 | 9/2012 | Way |
| 9,132,897 | B2 | 9/2015 | Barnes et al. |
| 9,352,812 | B1 | 5/2016 | Barnes et al. |
| D758,554 | S | 6/2016 | Lohmann |
| 9,487,925 | B1 | 11/2016 | Meriweather et al. |
| 9,604,709 | B2 | 3/2017 | Barnes |
| D826,702 | S | 8/2018 | Barnes et al. |
| D828,746 | S | 9/2018 | Barnes et al. |
| D828,747 | S | 9/2018 | Barnes et al. |
| 10,086,919 | B2 | 10/2018 | Barnes |
| D837,041 | S | 1/2019 | Barnes et al. |
| 10,267,003 | B2 | 4/2019 | Barnes et al. |
| 10,370,073 | B2 | 8/2019 | Barnes |
| D899,901 | S | 10/2020 | Barnes |
| D899,902 | S | 10/2020 | Barnes |
| D899,903 | S | 10/2020 | Barnes et al. |
| D899,904 | S | 10/2020 | Barnes et al. |
| 10,822,063 | B1 | 11/2020 | Barnes |
| 11,447,216 | B2 | 9/2022 | Barnes |
| 2002/0131821 | A1 | 9/2002 | Elson |
| 2005/0002741 | A1 | 1/2005 | Brensinger et al. |
| 2005/0271477 | A1 | 12/2005 | Sehl |
| 2006/0156964 | A1 | 7/2006 | Canniffe et al. |
| 2007/0248420 | A1 | 10/2007 | Jacobs et al. |
| 2008/0014028 | A1 | 1/2008 | Faires et al. |
| 2008/0276851 | A1 | 11/2008 | Weed |
| 2008/0306642 | A1 | 12/2008 | Figura et al. |
| 2009/0235857 | A1 | 9/2009 | Hodapp |
| 2011/0146554 | A1 | 6/2011 | Wright et al. |
| 2011/0274502 | A1* | 11/2011 | Tibedo ..... E02B 3/064 405/213 |
| 2011/0277675 | A1 | 11/2011 | Thom et al. |
| 2014/0010593 | A1 | 1/2014 | Davis |
| 2016/0368577 | A1 | 12/2016 | Gaveau |
| 2020/0115867 | A1 | 4/2020 | Kirby |
| 2020/0370261 | A1* | 11/2020 | Barnes ..... E02B 3/064 |
| 2021/0214059 | A1 | 7/2021 | Barnes |

FOREIGN PATENT DOCUMENTS

| | | | | |
|---|---|---|---|---|
| FR | 2860819 | | 4/2005 | |
| FR | 2974785 | A1 * | 11/2012 | ..... B63B 21/00 |
| FR | 3017595 | | 6/2014 | |
| GB | 2526833 | A * | 12/2015 | ..... E02B 3/064 |
| RU | 2529124 | | 9/2014 | |
| WO | WO1999014110 | | 3/1999 | |
| WO | WO2014035026 | | 3/2014 | |
| WO | WO2016053208 | | 4/2016 | |

OTHER PUBLICATIONS

U.S. Appl. No. 59/416,650, filed Aug. 24, 1999, Rueckert.
https://www.jetdock.com (excerpt printed Jan. 29, 2020).
Shoremaster, LLC, Official RhinoHoist Front Mount Floating Boat Life Video, YouTube, May 10, 2013, https://www.youtube.com/watch?v-ayxgoTHCijl.

* cited by examiner

PILE GUIDE WITH REPLACEABLE INSERTS

BACKGROUND OF THE INVENTION

Piles are vertical posts or poles driven into the ground or attached to other objects. Piles may be formed of wood, concrete, steel or other materials. Commonly, piles are used to stabilize or hold other objects. In a typical application, piles are driven into the ground and a floating dock or similar floating object is held horizontally in place by the pile. The floating dock of other floating object comprises a pile guide. The pile extends through an internal area of the pile guide that allows vertical movement of the dock of other floating object relative to the pile, but retards horizonal movement.

Pile guides in common use have inadequate service lives. Most pile guides in common use are formed of metal. Metal pile guides are not sufficiently resistant to environmental factors such as weather and sunlight. Particularly in salt water applications, corrosion of metals, even galvanized metals, leads to replacement of the pile guides.

As the pile guide moves upwardly and downwardly relative to the pile, friction is present between the pile and the pile guide. Concrete piles in particular result in abrasion and wear of the pile guide. In some cases, the pile guide may comprise wheels to reduce friction, but wheels require bearings that do not have a long service life in wet applications, and particularly in salt water.

Steel piles may result in less frictional interaction with the pile guide than concrete piles or wood piles, but steel piles are subject to corrosion. Some steel piles may be coated to resist corrosion, but the coating wears off due to weather and abrasion with the pile guide, exposing steel surfaces to weather and salt water, and the resulting corrosion.

Abrasion and wear of pile guides is exacerbated by inaccurate placement of piles, especially piles that are driven or otherwise placed in the ground. The spacing of piles may not match the position of pile guides on a floating dock or floating object with precision. Piles may not be positioned exactly vertically. These factors mean that piles may place more force, and therefore more, or even complete, loading one side of the pile guide, resulting in more rapid wear of one side of the pile guide. However, the solution is frequently to replace the entire pile guide at substantial trouble and expense.

There is a need for a low friction pile guide that is resistant to environmental degradation, and also has easily replaceable components.

SUMMARY OF THE INVENTION

The present invention is a pile guide having a body formed of thermoplastic polymer, such as polyethylene. The body has an internal area constructed and arranged to receive and retain a pile in the internal area of the body. A plurality of spaced apart inserts formed of thermoplastic polymer, such as polyethylene, are attached to the internal area of the body and extend outwardly from the internal area of the body so that contact of the pile is with the inserts. The inserts are replaceable so that as the inserts wear due to frictional engagement with the pile, worn inserts may be replaced without replacement of the other components of the pile guide. The inserts are preferred to be formed of a corrosion resistant, low friction, chemical resistant, high impact and low moisture absorbing thermoplastic material.

BRIEF DRAWING DESCRIPTION

DESCRIPTION OF PREFERRED EMBODIMENTS

Figure 2:
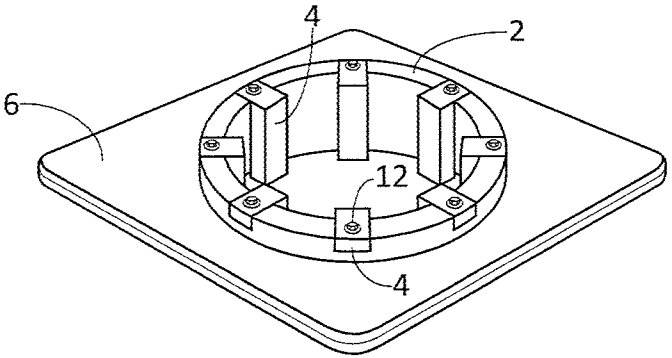
FIG. 2 shows a perspective view of an embodiment of the pile guide according to the invention.
Figure 3:
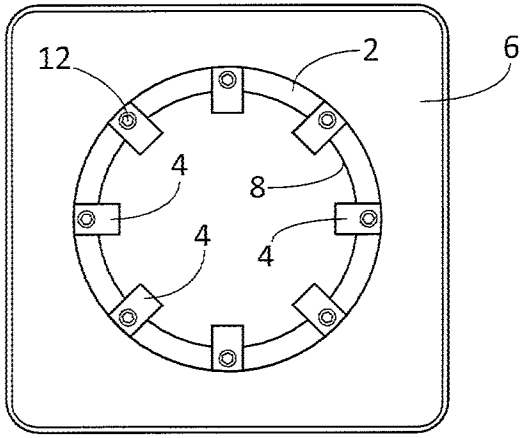
FIG. 3 shows an elevation of an embodiment of the pile guide according to the invention.
Figure 1:
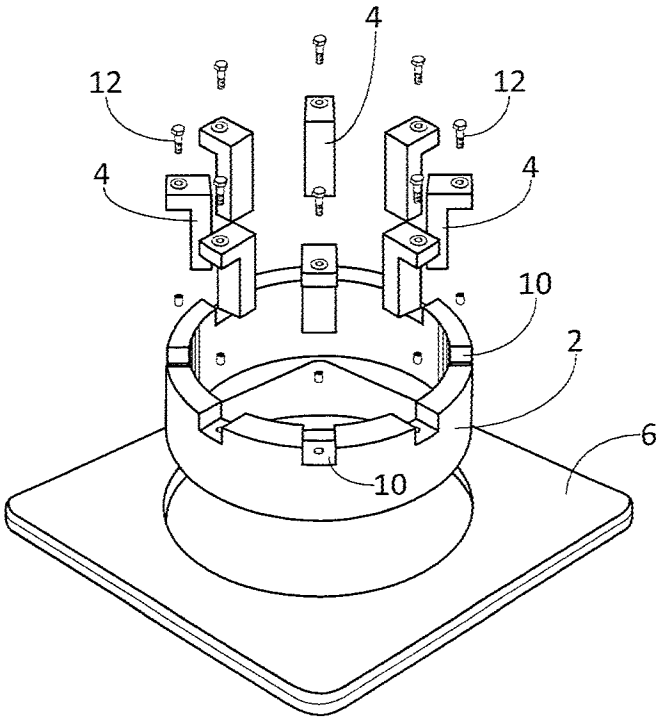
FIG. 1 shows an exploded view of an embodiment of the pile guide according to the invention.
Figure 5:
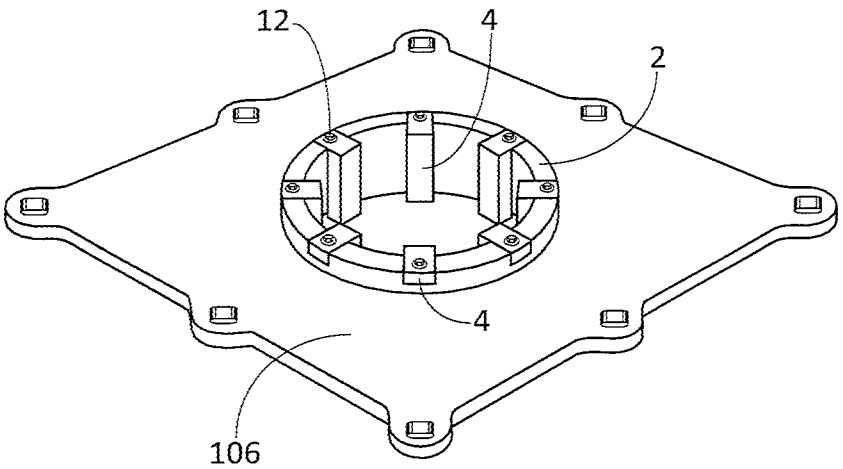
FIG. 5 shows a perspective view of another embodiment of the pile guide according to the invention.
Figure 4:
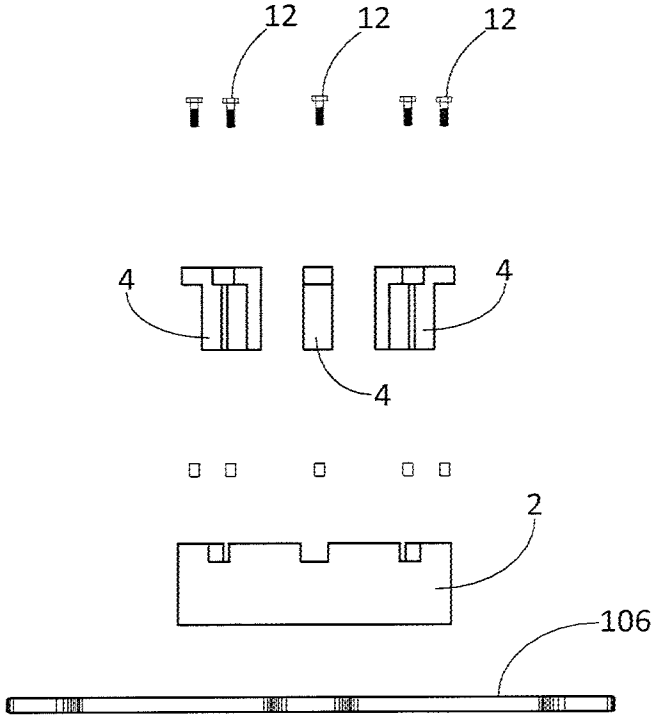
FIG. 4 shows an exploded view of another embodiment of the pile guide according to the invention.

FIGS. 1, 2 and 3 show an exemplary embodiment of the pile guide of the invention. FIG. 1 shows a body 2 and inserts 4. Also shown is attachment plate 6 that allows the body to be attached to another object, such as a floating dock. The attachment plate may be of various forms depending upon the application of the pile guide. The attachment plate is preferred to be welded to the body.

The body 2 of the invention as shown in this embodiment is circular and annular. The body has an internal circumference 8 through which a pile traverses as the pile guide moves vertically in use. The body has a plurality of slots 10 formed in the top surface of the body for receiving the inserts. It is preferred that the body is formed as a continuous member having no gaps.

In this embodiment, the inserts 4 are formed as an inverted "L" shape. The shorter leg of the L meets the longer leg at 90° angle. The shorter leg is inserted into a slot 10 of the body 2 and fastened to the body. The inserts are preferred to be attached to the body by a fastener 12 that is removable, such as a threaded fastener, which allows each insert to be replaced as necessary due to wear or other defects in the insert. The inserts extend outwardly from the internal circumference of the body so that they are positioned between the pile and the body.

Figure 10:
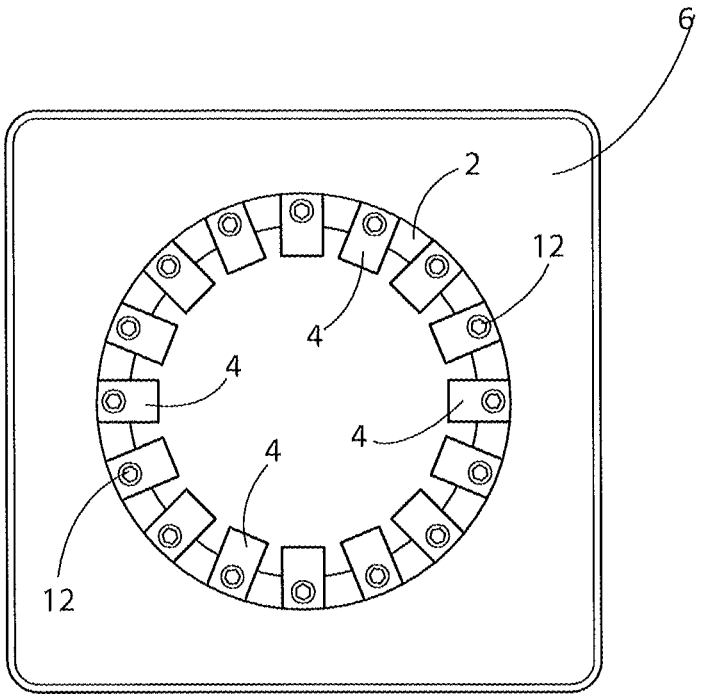
FIG. 10 shows a top plan view of another embodiment of the pile guide according to the invention.

In this embodiment, there are eight (8) inserts 4 that are spaced apart at equal intervals. As shown in FIG. 3, an insert is present every 45°, measured from the center of the inserts. When the inserts are spaced apart, eight (8) inserts are preferred to be used to meet goals of the invention. When eight (8) inserts are used, they are 45° apart. If twelve (12) inserts are used, they are spaced 30° apart. 360° divided by the number of inserts provides the spacing. FIG. 10 shows sixteen (16) inserts that surround substantially the entire internal perimeter of the body.

In a preferred embodiment, the inserts 4 are formed of ultra-high molecular weight polyethylene (UHMW). UHMW is preferred because it has high sliding capabilities and is abrasion resistant. UHMW provides reduced friction and reduced wear due to abrasion as compared to other materials and other thermoplastics. UHMW is also corrosion resistant, has high impact strength and low water absorption compared to other materials and thermoplastics.

However, UHMW is difficult to form into shapes, such as by machining, compared to other thermoplastics. Therefore, the use of multiple small inserts 4 of a simple geometric shape is preferred over larger inserts of more complex geometry. The eight (8) inserts shown in the embodiments depicted in FIGS. 1-9 occupy less than ⅓ of the internal circumference 8 of the body 2, and are formed in the simple inverted L shape. The cost to form the inserts and the cost of material is reduced by this construct.

The body 2 is formed of a thermoplastic such as polyethylene. One material that may be used is high density polyethylene (HDPE). HDPE is easy to machine, easy to form and easy to weld, while providing high strength to density. HDPE has excellent impact resistance and is corrosion proof. HDPE is less expensive than UHMW. HDPE provides lower material cost for the relatively larger body than a body formed of UHMW. (UHMW would be difficult to form as the body.) The HDPE body can be welded to the attachment plate 6. The combination of UHMW and a thermoplastic such as HDPE provides a pile guide that is strong and is corrosion and weather resistant in hostile environments such as marine applications, while providing abrasion resistance and low friction when sliding against a pile. The UHMW inserts 4 can be easily and cost effectively replaced, without the necessity of removing and replacing an entire pile guide or removing the pile guide body from the pile.

The pile guide is therefore formed of two materials that are preferred to be durable and corrosion resistant, such as thermoplastics. The body 2 is formed of a first thermoplastic, and the inserts 4 are formed of a second thermoplastic that has lower frictional characteristics than the first thermoplastic; that is, the second thermoplastic has higher sliding characteristics than the first thermoplastic.

In an embodiment of the invention, attachment plate 6 is formed of the same thermoplastic as the first thermoplastic of the body 2. While the drawings show the attachment plate as a flat plate, the attachment plate is not limited to any particular structure, but may be formed as required by the particular application. FIGS. 4, 5, 8 and 9 show the body and inserts of FIGS. 1, 2 and 3, but provide examples of other attachment plate structures (106, 206, 306) that are attached, such as by welding, to the body.

Figure 7:
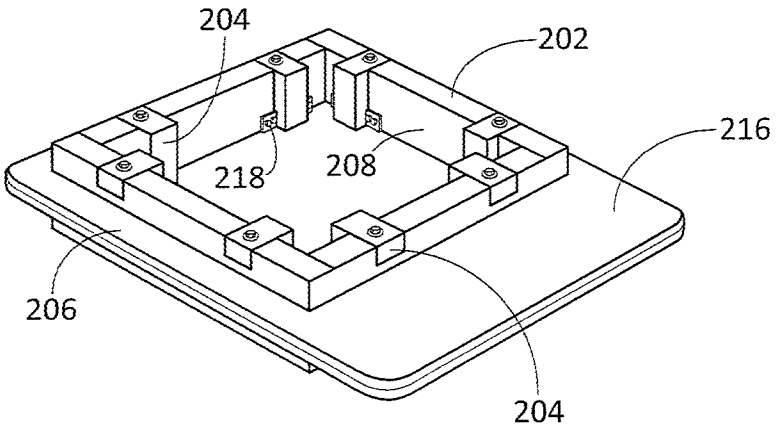
FIG. 7 shows a perspective view of another embodiment of the pile guide according to the invention.
Figure 6:
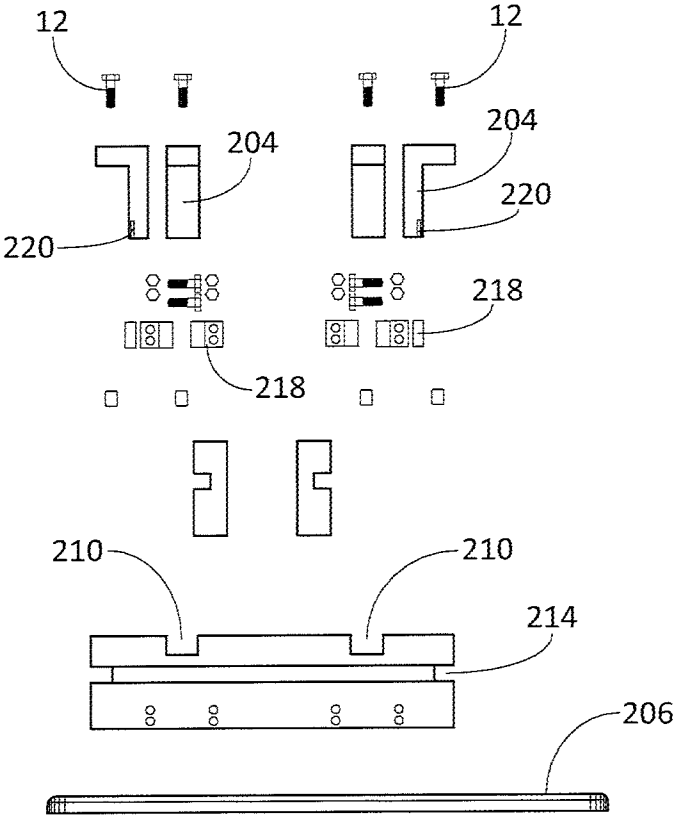
FIG. 6 shows an exploded view of another embodiment of the pile guide according to the invention.
Figure 8:
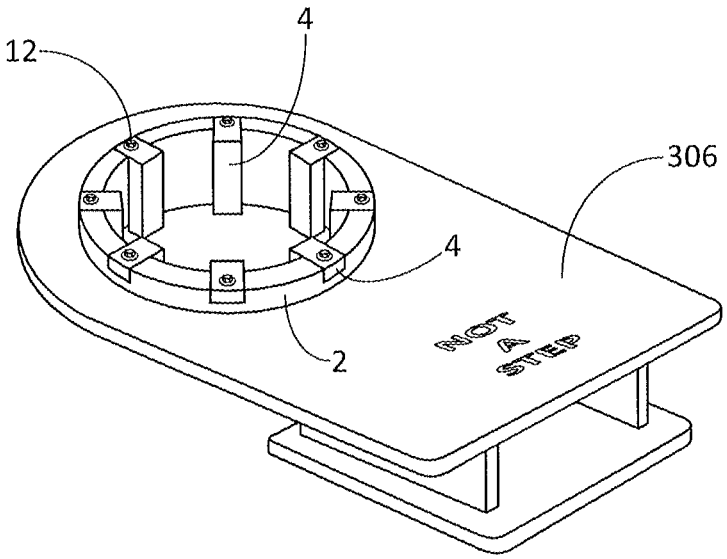
FIG. 8 shows a perspective view of another embodiment of the pile guide according to the invention.

FIGS. 6 and 7 demonstrate that a body 202 of the pile guide may be formed in geometric configurations other than round. The body of the pile guide in FIGS. 6 and 7, is rectangular, and more particularly, square. Some piles, such as concrete piles, have a rectangular cross section. The shape of the body is formed to accommodate the horizontal cross section of the pile. The body is continuous about its internal perimeter 208. While the rectangular cross section may be formed in four (4) pieces, there are no gaps present where each of the four sides meet adjoining sides so that the body is continuous.

The body 202 and inserts 204 as shown in FIGS. 6 and 7 are formed of materials consistent with the goals of the invention as disclosed with regard to the embodiment shown FIGS. 1, 2 and 3. The rectangular body of FIGS. 6 and 7 is preferred to have slots 210 in the top of the body that assist in holding the inserts in place. The inserts are attached in a manner that allows the inserts to be replaced due to wear or other defects. The inserts may be attached to the body with threaded fasteners 12 as shown.

The attachment plate 206 as shown in FIG. 7 is another example of a configuration for the attachment plate. The attachment plate is attached to the body 202 such as by welding, and may be formed of the same thermoplastic as the body. The body may have a receiving slot 214 for positioning the attachment plate on the body.

The attachment plate 206 as shown in FIG. 7 has an extension 216 that may be useful in attaching the pile guide to an object such as a floating dock. The attachment plate may be fastened to an object by fasteners that extend through the attachment plate, or the extension may be held in place by brackets through which the extension is inserted.

FIGS. 6 and 7 show clips 218 that may be used to further stabilize a lower end of the inserts 204. The clips are positioned at a lower end of the inserts and are attached to the body 202. In one embodiment the clips are "L" shaped, with one side of the clip attached to the body and the other side of the clip abutting the insert. A clip is present on both sides of the insert. The clips bracket the insert without attachment to the insert. The clips could be attached to the insert, such as by a fastener, although the additional fasteners make replacement of the inserts more difficult and is not preferred. If no fastener is used to attach the clips, inserts can be replaced while the clips remain in place on the body to receive the new inserts.

In another embodiment of the clips 218, the clips are Z-shaped. A first end of the Z-shaped clip is attached to the body, such as by a fastener. The opposite end of the Z-shaped clip is inserted into a slot 220 formed in the inserts. The middle section of the Z-shaped clip meets the ends at a right angle.

Clips may be used in geometric configurations of the body other than the rectangular body to provide additional stabilization of the inserts, especially where the pile guide is large and/or the inserts are exposed to substantial force. The clips should not extend across the sides of the inserts further than necessary so that the useful life of the inserts is not greatly reduced as the inserts wear. The slots 220 as shown in FIG. 6 indicate that the clip 218 extends to substantially less than the midpoint of the outwardly facing side of the insert.

Figure 9:
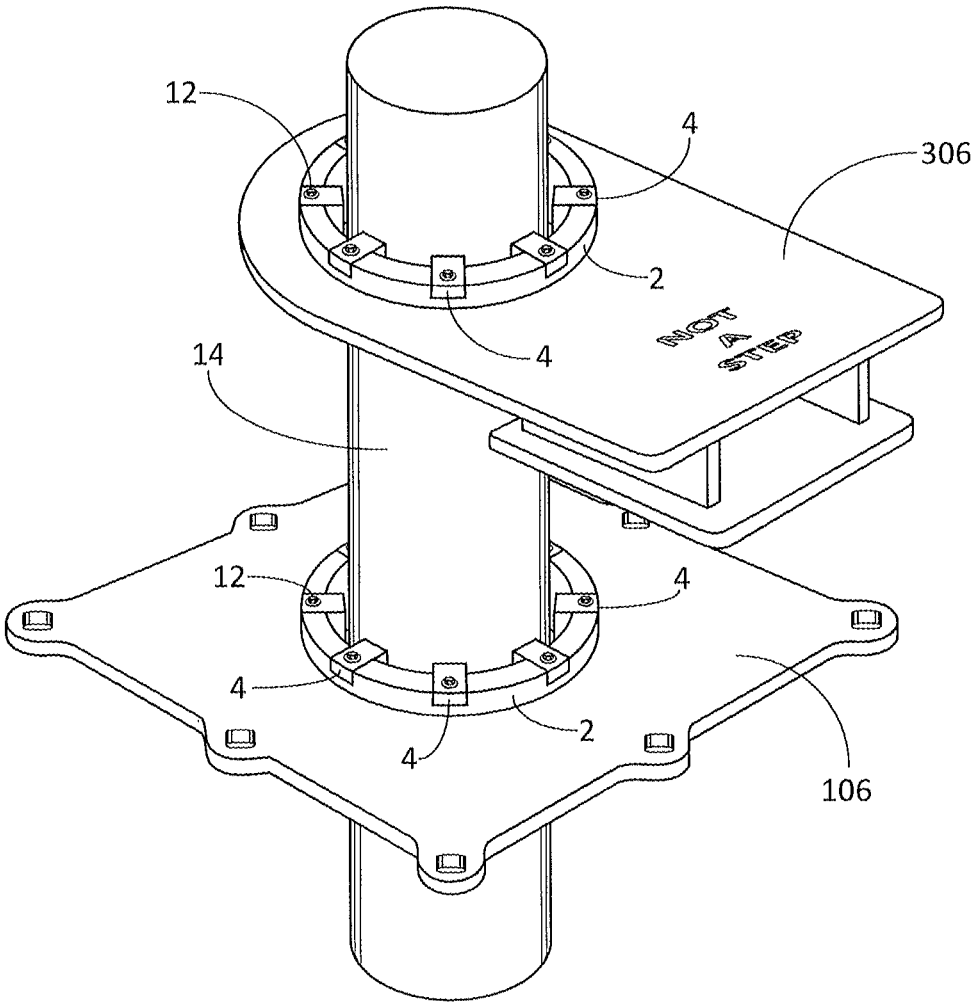
FIG. 9 shows a perspective view of another embodiment of the pile guide according to the invention, combining the pile guide of FIG. 5 with the pile guide of FIG. 9.

FIG. 9 demonstrates that multiple pile guides according to the invention may be used with a single pile 14 to attach multiple objects to a pile. Multiple pile guide constructs used in combination need not be of the same configuration.

In yet another embodiment of the invention, the inserts may be formed in multiple parts that cover the entire or substantially the internal circumference of the body. There are not fewer than two (2) inserts. For example, the inserts may be formed as semi-circles that collectively form a circle that covers the entire internal circumference of the body. The inserts could comprise more than two (2) inserts, but not less than two, since the inserts must be easily removable, and because one (1) insert is likely to be subject to more wear than the remaining inserts. The body and inserts may be formed of materials as indicated herein, and the inserts attached to the body so as to be removable. Threaded fasteners may be used to attach the inserts to the top of the body as shown in the drawings.

In each embodiment, an insert or inserts attached to one side of the body may extend further into the internal area of the body than inserts on another side of the internal area of the body. The installer may observe that a pile has an orientation that will bias the pile toward one side of the pile guide. To accommodate for this bias, an insert or inserts may extend further out from the body, such as by being thicker, providing more thermoplastic material on one part of the internal area of the body to compensate for the anticipated increase in wear.

What is claimed:

1. A pile guide, comprising:

a body having an internal area constructed and arranged to receive and retain a pile therein, a plurality of spaced apart inserts formed of thermoplastic polymer, wherein the plurality of spaced apart inserts are attached to the internal area of the body and extend outwardly from the internal area of the body, wherein the body comprises a plurality of spaced apart slots formed in the body, and each slot of the plurality of spaced apart slots is formed and arranged to receive an insert of the plurality of inserts, and each insert of the plurality inserts is held in a slot of the plurality of spaced apart slots.

2. A pile guide as described in claim 1, wherein the plurality of spaced apart inserts are formed of thermoplastic polymer having greater abrasion resistance than the material from which the body is formed.

3. A pile guide as described in claim 2, wherein the plurality of spaced apart inserts are formed of ultra-high molecular weight (UHMW) polyethylene.

4. A pile guide as described in claim 1, further comprising a first clip and a second clip attached to an internal area of the body, wherein the first clip is present on a first side of a lower portion of an insert of the plurality of inserts and the second clip is present on a second side of the lower portion of the insert of the plurality of inserts.

5. A pile guide as described in claim 1, wherein an insert of the plurality of inserts comprises a slots formed in a lower portion thereof, and further comprising a first clip and a second clip attached to an internal area of the body, wherein the first clip is positioned in a slot formed in the lower portion of the insert and the second clip is positioned in a slot formed in the lower portion of the insert.

6. A pile guide as described in claim 1, wherein the plurality of spaced apart inserts are formed of ultra-high molecular weight (UHMW) thermoplastic polymer and the body is formed of high density thermoplastic polymer.

7. A pile guide as described in claim 1, wherein each insert of the plurality of spaced apart inserts are no more than 45° from a center of each adjoining insert of the plurality of spaced apart inserts.

8. A pile guide as described in claim 1, wherein an insert of the plurality of spaced apart inserts extends further into the body than another insert of the plurality of spaced apart inserts.

9. A pile guide as described in claim 1, wherein the plurality of inserts extend outwardly from the internal area of the body, and cover substantially an entire internal area of the body.

10. A pile guide as described in claim 1, wherein an insert of the plurality of inserts is shaped as an inverted "L", wherein a first leg of the inverted "L" meets a shorter leg of the inverted "L" of the plurality of inserts at substantially a 90° angle.

11. A pile guide as described in claim 1, wherein an insert of the plurality of inserts is shaped as an inverted "L", wherein a first leg of the inverted "L" meets a shorter leg of the inverted "L" at substantially a 90° angle, and wherein a fastener is positioned in the shorter leg of the inverted "L" and connects the insert to the body.

12. A pile guide as described in claim 1, wherein the body comprises a slot formed in the body, and wherein an insert of the plurality of inserts is shaped as an inverted "L", wherein a first leg of the inverted "L" meets a shorter leg of the inverted "L" at substantially a 90° angle, and the shorter leg of the inverted "L" of the insert is positioned in the slot formed in the body.

13. A pile guide as described in claim 1, wherein the plurality of spaced apart inserts are formed of thermoplastic polymer having greater abrasion resistance and lower frictional properties than the material from which the body is formed.

14. A pile guide as described in claim 1, wherein an insert of the plurality of inserts is shaped as an inverted "L", wherein a first leg of the inverted "L" meets a second leg of the inverted "L" at substantially a 90° angle, and wherein a surface of the first leg is positioned against a surface of the internal area of the body along substantially an entire length of the first leg.

15. A pile guide, comprising:

a body having an internal area constructed and arranged to receive and retain a pile therein, a plurality of spaced apart inserts formed of thermoplastic polymer, wherein the plurality of spaced apart inserts are attached to the internal area of the body and extend outwardly from the internal area of the body, wherein the body comprises a plurality of spaced apart slots formed in an upper surface of the body, and each slot of the plurality of spaced apart slots is formed and arranged to receive an insert of the plurality of inserts, and each insert of the plurality inserts occupies a slot of the plurality of spaced apart slots.

16. A pile guide as described in claim 15, wherein an insert of the plurality of inserts is shaped as an inverted "L" having a first leg and a second leg that meet at substantially a 90° angle, and the second leg occupies a slot of the plurality of spaced apart slots.

17. A pile guide as described in claim 15, wherein an insert of the plurality of inserts is shaped as an inverted "L" having a first leg and a second leg that meet at substantially a 90° angle, and the second leg occupies a slot of the plurality of spaced apart slots, and wherein a fastener connects the second leg to the body.

18. A pile guide as described in claim 15, wherein an insert of the plurality of inserts is shaped as an inverted "L", wherein a first leg of the inverted "L" meets a shorter leg of the inverted "L" at substantially a 90° angle.

19. A pile guide as described in claim 15, wherein an insert of the plurality of inserts is shaped as an inverted "L", wherein a first leg of the inverted "L" meets a shorter leg of the inverted "L" at substantially a 90° angle, and wherein a fastener connects the shorter leg of the insert to the body.

20. A pile guide as described in claim 15, wherein an insert of the plurality of inserts is shaped as an inverted "L", wherein a first leg of the inverted "L" meets a second leg of the inverted "L" at substantially a 90° angle, and wherein a surface of the first leg is positioned against a surface of the internal area of the body along substantially an entire length of the first leg.

21. A pile guide, comprising:

a body having an internal area constructed and arranged to receive and retain a pile therein, a plurality of spaced apart inserts formed of thermoplastic polymer, wherein the plurality of spaced apart inserts are positioned in the internal area of the body, wherein an insert of the plurality of inserts is shaped as an inverted "L" having a first leg and a second leg that meet at substantially a 90° angle, and the second leg extends over a top of the body, and the first leg extends downwardly into the internal area of the body.

22. A pile guide as described in claim 21, further comprising a first clip and a second clip attached to the internal area of the body, wherein the first clip is present on a first side of the first leg and the second clip is present on a second side of the first leg.

23. A pile guide as described in claim 21, wherein the insert of the plurality of inserts is attached to the top of the body by a fastener connecting the second leg to the top of the body.

24. A pile guide as described in claim 21, wherein a surface of the first leg is positioned against a surface of the internal area of the body along substantially an entire length of the first leg.

25. A pile guide as described in claim 21, wherein the first leg is longer than the second leg and the first leg is positioned against a surface of the internal area of the body along substantially an entire length of the first leg.

* * * * *